US007086866B1

(12) United States Patent
Folan et al.

(10) Patent No.: US 7,086,866 B1
(45) Date of Patent: Aug. 8, 2006

(54) CIRCUIT BOARD MOUNTED ELECTRICAL CONNECTOR

(75) Inventors: Eugene Folan, Ennis (IE); Francis Duggan, Shannon (IE); Kieran Wright, Ennis (IE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/260,762

(22) Filed: Oct. 27, 2005

(51) Int. Cl.
*H01R 29/00* (2006.01)

(52) U.S. Cl. ..... 439/53; 439/108; 439/637; 439/954

(58) Field of Classification Search ..... 439/63, 439/108, 637, 79, 53
See application file for complete search history.

(56) References Cited

U.S. PATENT DOCUMENTS

| | | | | |
|---|---|---|---|---|
| 3,853,380 | A | 12/1974 | Baker | |
| 4,734,043 | A | 3/1988 | Emert | |
| 4,756,694 | A * | 7/1988 | Billman et al. | 439/61 |
| 4,907,978 | A | 3/1990 | Bowen | |
| 5,116,237 | A * | 5/1992 | Loewen | 439/326 |
| 5,304,069 | A * | 4/1994 | Brunker et al. | 439/108 |
| 5,378,160 | A * | 1/1995 | Yumibe et al. | 439/66 |
| 5,498,174 | A | 3/1996 | Speer et al. | |
| 5,540,598 | A * | 7/1996 | Davis | 439/79 |
| 5,785,556 | A * | 7/1998 | Pratt et al. | 439/637 |
| 6,918,793 | B1 * | 7/2005 | Baker et al. | 439/668 |
| 6,994,593 | B1 * | 2/2006 | Baker et al. | 439/668 |

* cited by examiner

*Primary Examiner*—Tulsidas C. Patel
*Assistant Examiner*—Harshad C Patel
(74) *Attorney, Agent, or Firm*—Stephen Z. Weiss

(57) ABSTRACT

An electrical connector system includes a connector mounted on a printed circuit board and mateable with a mating connector in a mating direction at an acute angle to the circuit board. A connector housing mounts at least two sets of first and second terminals. The connector housing is mountable on the circuit board in a mounting direction generally perpendicular to the board. The first terminals have tail portions extending in the mounting direction generally perpendicular to the circuit board. The second terminals have tail portions extending at an acute angle to the mounting direction. The printed circuit board has holes for receiving the tail portions of the first terminals and elongated slots for receiving the angled tail portions of the second terminals. The slots are sufficiently long to accommodate distal ends of the angled tail portions which extend at the acute angle to the mounting direction.

8 Claims, 3 Drawing Sheets

FIG. 1
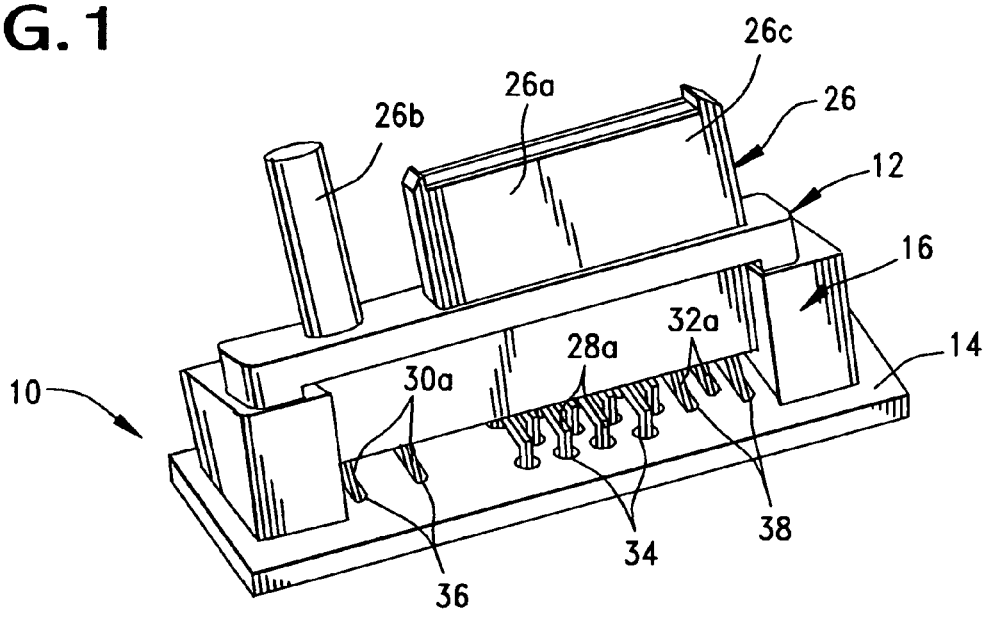
FIG. 2
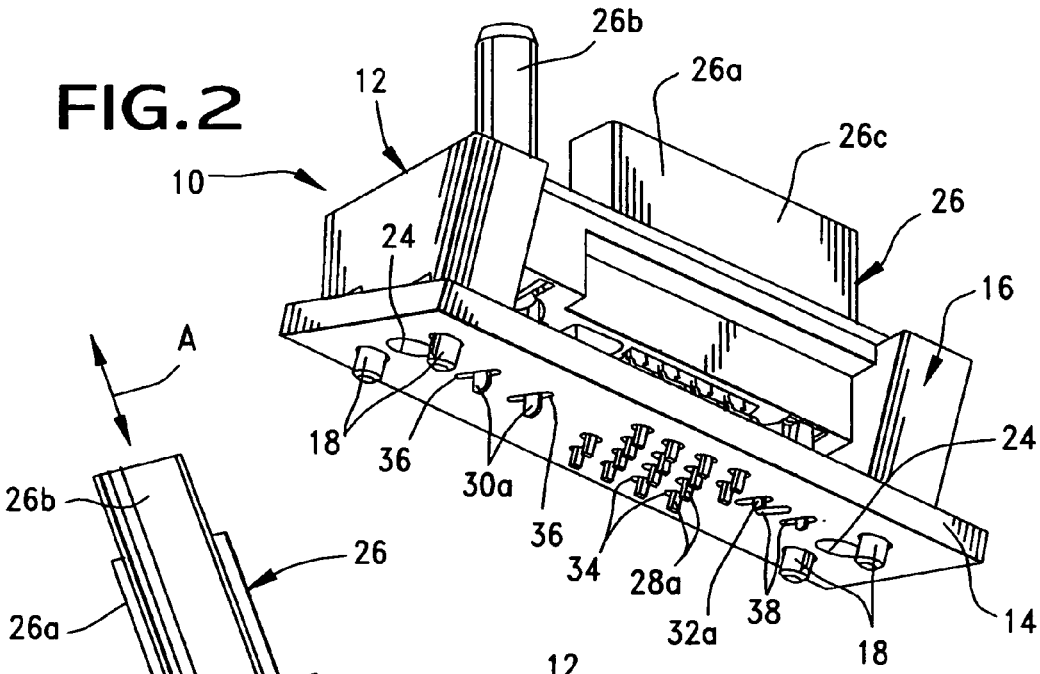
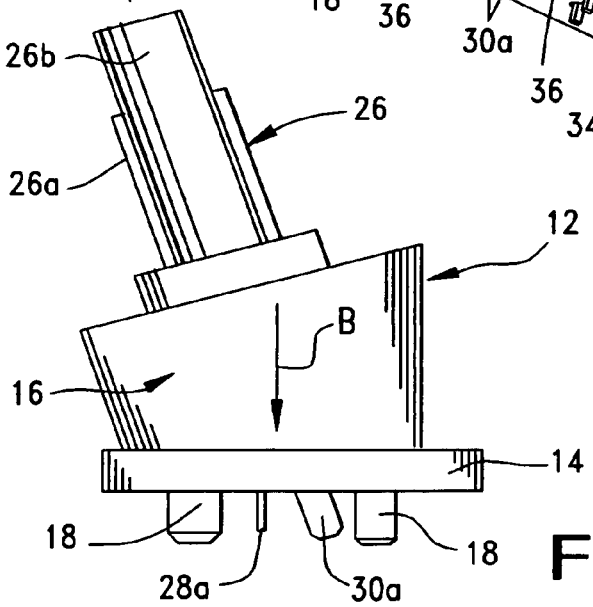
FIG. 3

CIRCUIT BOARD MOUNTED ELECTRICAL CONNECTOR

FIELD OF THE INVENTION

This invention generally relates to the art of electrical connectors and, particularly, to an electrical connector system which includes a connector mounted on a printed circuit board.

BACKGROUND OF THE INVENTION

Circuit board mounted electrical connector systems typically include an electrical connector mounted on a printed circuit board. The connector is mateable with a complementary mating connector. The connector typically includes a dielectric housing mounting a plurality of conductive terminals. The terminals have tail portions for connection, as by soldering, to appropriate circuit traces on the printed circuit board. The tail portions may be surface connected to the circuit traces, or the tail portions may be inserted into holes in the printed circuit board for solder connection to circuit traces on the board and/or in the holes.

Most often, the board mounted connector is mateable with the mating connector in a mating direction generally perpendicular to the printed circuit board. In such instances, the tail portions of the connector terminals are inserted perpendicularly into the holes in the circuit board. In some instances, the connector, particularly the connector housing, is configured for mating with the mating connector in a mating direction at an acute angle to the circuit board. In these instances, the tail portions of the terminals are bent so that they, again, are inserted into the holes in the circuit board generally perpendicularly to the board.

Problems are encountered with certain connectors which are called "hybrid connectors" in that a single connector is used as a power connector, a signal connector, an RF connector or the like. In other words, a single connector housing may mount relatively small or thin signal or data terminals, along with more robust power or RF terminals. The problems occur when the hybrid connector is mounted on a printed circuit board in a mating direction at an acute angle to the board. While the thinner tail portions of the signal or data terminals can be easily bent for insertion perpendicularly into the holes in the circuit board, notwithstanding the angled orientation of the connector, it is quite difficult to bend the tail portions of the more robust power terminals, RF terminals or the like. Considerable added manufacturing costs are encountered in performing such operations. The present invention is directed to a system wherein a hybrid connector can be mounted on a printed circuit board with the tail portions of some terminals inserted perpendicularly into holes in the board while the tail portions of other terminals are inserted into slots in the circuit board while the tail portions still are at an acute angle relative thereto.

SUMMARY OF THE INVENTION

An object, therefore, of the invention is to provide a new and improved electrical connector system which includes a connector mounted on a printed circuit board and for mating with a mating connector in a mating direction at an acute angle to the circuit board.

In the exemplary embodiment of the invention, a connector housing mounts at least two sets of first and second terminals. The connector housing is mountable on the circuit board in a mounting direction generally perpendicular to the board. The first terminals have tail portions extending in the mounting direction generally perpendicular to the circuit board. The second terminals have tail portions extending at an acute angle to the mounting direction. The printed circuit board has holes for receiving the tail portions of the first terminals and elongated slots for receiving the angled tail portions of the second terminals. The slots are sufficiently long to accommodate distal ends of the angled tail portions which extend at the acute angle to the mounting direction.

According to one aspect of the invention, the connector housing has a mating portion which extends in the mating direction for mating with the mating connector at an acute angle to the printed circuit board. The mating portion may have different sections, such as a signal section, a power section and/or an RF section.

According to another aspect of the invention, the connector housing comprises a housing of a hybrid connector. The first terminals comprise signal terminals and the second terminals comprise power terminals. A set of third terminals may comprise RF terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 1 is a perspective view of an electrical connector system according to the invention, including a connector mounted on a printed circuit board and viewed generally from the top thereof;

FIG. 2 is a view similar to that of FIG. 1, but viewed generally from the bottom of the circuit board;

FIG. 3 is a side elevational view of the connector mounted on the circuit board;

DETAILED DESCRIPTION OF THE PREFERRED EMBODIMENT

Figure 4:
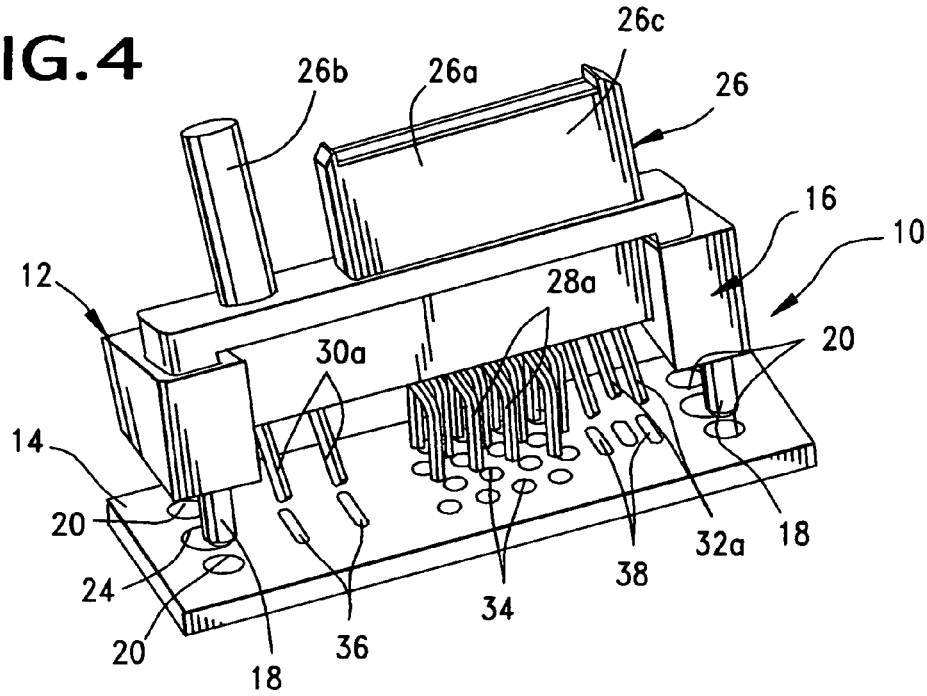
FIG. 4 is a top perspective view showing the connector removed from the circuit board.
Figure 5:
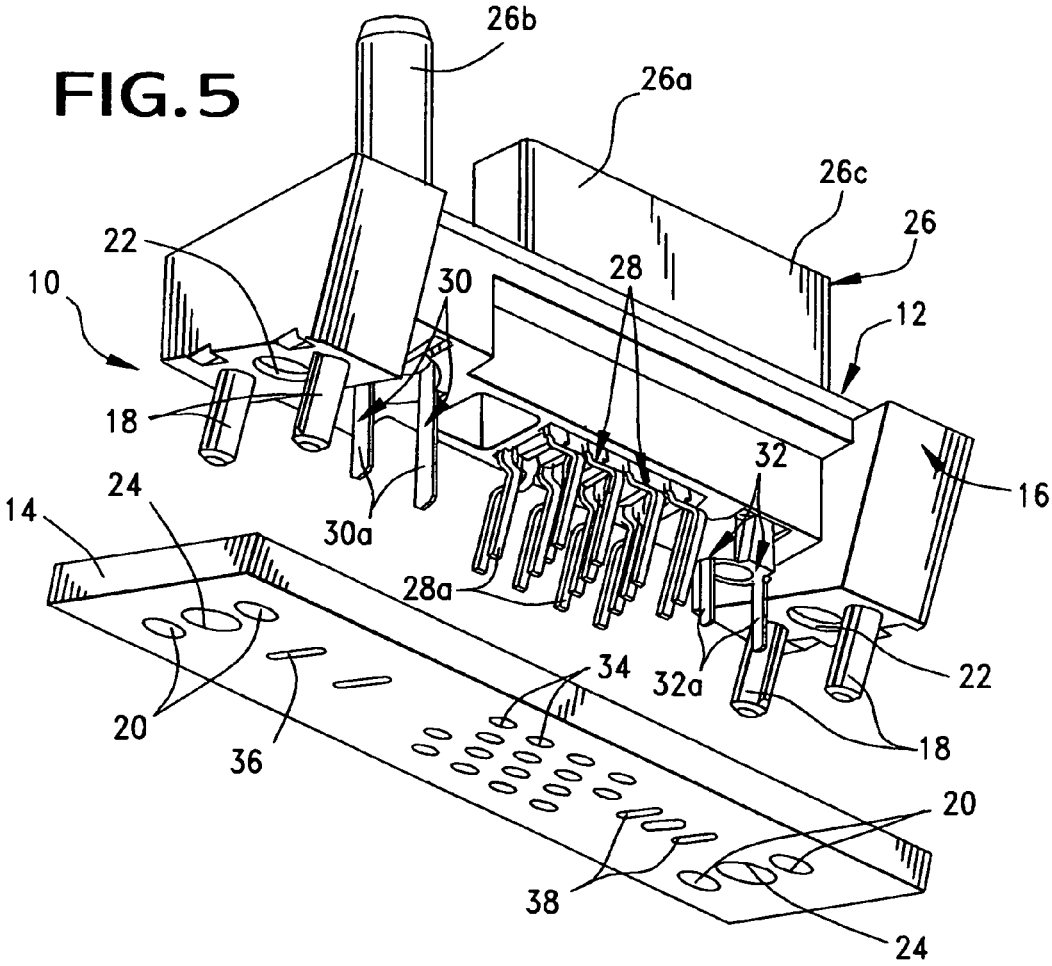
FIG. 5 is a view similar to that of FIG. 4, but viewed from the bottom of the circuit board.

Referring to the drawings in greater detail, and first to FIGS. 1–5, the invention is embodied in an electrical connector system, generally designated 10, which includes an electrical connector, generally designated 12, mountable on a printed circuit board 14. The connector is mateable with a mating connector (not shown) in a mating direction, indicated by the double-headed arrow "A" in FIG. 3, which is at an acute angle to circuit board 14. In other words, printed circuit board 14 is a typical planar circuit board, and mating direction "A" is at an acute angle to the plane of the board. The connector is mountable to the circuit board in the direction of arrow "B" perpendicular to the circuit board.

Connector 12 includes a dielectric housing, generally designated 16, which may be molded of insulating plastic material or the like. The housing is elongated and includes two pairs of mounting posts 18 at opposite ends thereof for insertion into a pair of mounting holes 20 in printed circuit board 14. The housing may also include a fastening hole 22 at each opposite end thereof for receiving fasteners (not shown) which extend through fastening holes 24 in the circuit board.

Connector housing 16 further includes a composite mating portion, generally designated 26, which (as best seen in FIG. 3) extends at the acute angle to circuit board 14, i.e., in mating direction "A". Connector 12 is a "hybrid connector" in that the connector functions as a signal or data connector, a power connector as well as an RF connector. To that end, mating portion 26 includes a signal (or data) section 26*a*, a power section 26*b* and an RF section 26*c*. As seen in FIG. 3, all of the sections of mating portion 26 extend at the acute angle to circuit board 14.

According to the hybrid nature of connector 12, housing 16 mounts a plurality of signal terminals, generally designated 28; a plurality of power terminals, generally designated 30; and a plurality of RF terminals, generally designated 32. Signal terminals 28 have tail portions 28*a* for insertion into holes 34 in circuit board 14. Power terminals 30 have tail portions 30*a* for insertion into elongated slots 36 in the circuit board. RF terminals 32 have tail portions 32*a* for insertion into elongated slots 38 in the circuit board. Signal terminals 28, power terminals 30 and RF terminals 32 have respective contact portions extending into sections 26*a*, 26*b* and 26*c*, respectively, of mating portion 26 of the connector housing.

It can be seen that tail portions 28*a* of signal terminals 28 are relatively thin. On the other hand, tail portions 30*a* of power terminals 30 are more robust. In addition, tail portions 30*a* of the power terminals are wider and generally flat in planes generally perpendicular to the angled orientation of power section 26*b* of the mating portion 26 of the connector. Similarly, while tail portions 32*a* of RF terminals 32 may not be as robust as tail portions 30*a* of power terminals 30, tail portions 32*a* of the RF terminals also are generally flat in planes perpendicular to the angled orientation of the connector. Consequently, while the thinner tail portions 28*a* of signal terminals 28 may be easily bent at selected angles, tail portions 30*a* of power terminals 30 and tail portions 32*a* of RF terminals 32 cannot be readily bent without costly manufacturing processes.

Figure 6A:
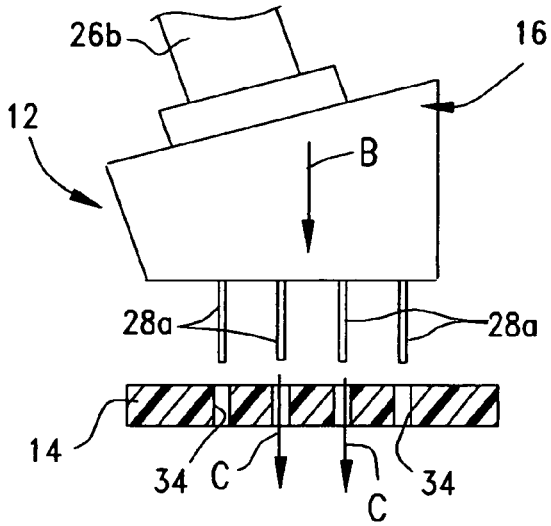
FIG. 6A is a fragmented section showing the tail portions of the signal terminals extending perpendicularly to the circuit board and about to be inserted through holes in the circuit board.
Figure 6B:
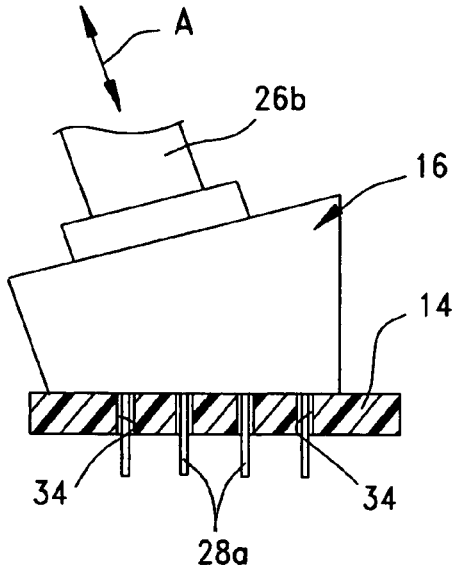
FIG. 6B is a view similar to that of FIG. 6A, but with the tail portions inserted into the holes in the circuit board.

With the above understandings of the structures of the tail portions of the signal, power and RF terminals 28, 30 and 32, respectively, reference is made to FIGS. 6A and 6B in conjunction with FIGS. 1–5. FIGS. 6A and 6B show four tail portions 28*a* of four signal terminals inserted into holes 34 in circuit board 14. It can be seen that the tail portions of the signal terminals have been easily bent so that the tail portions extend perpendicularly to the circuit board. Consequently, the tail portions of the signal terminals are inserted into holes 34 in the circuit board in the direction of arrows "C" which are perpendicular to the board and parallel to mounting direction "B" (FIG. 3) of connector 12 onto circuit board 14.

Figure 7A:
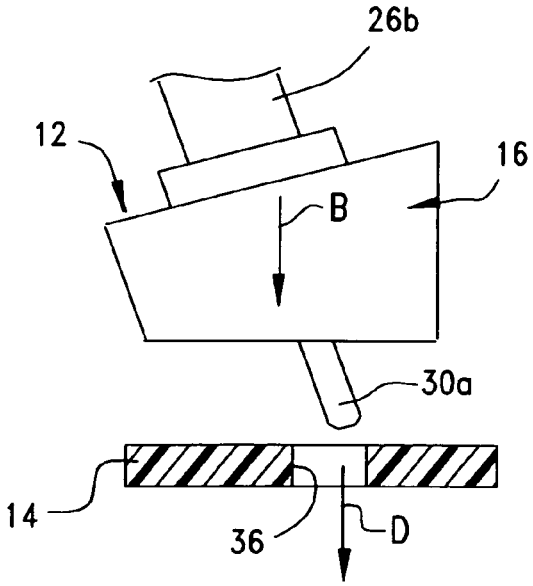
FIG. 7A is a view similar to that of FIG. 6A, with the angled power or RF terminals about to be inserted through elongated slots in the circuit board.
Figure 7B:
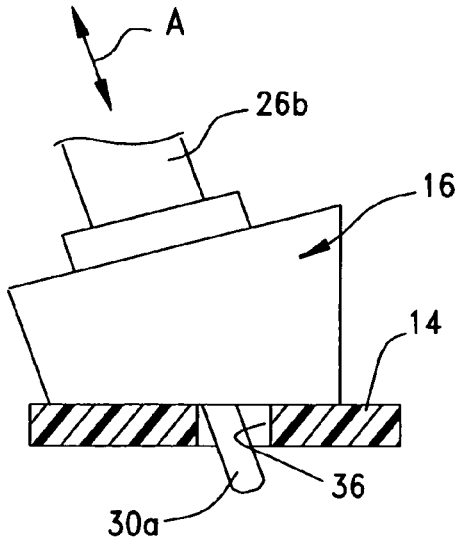
FIG. 7B is a view similar to that of FIG. 7A, but with the tail portions inserted into the slots in the circuit board.

Referring to FIGS. 7A and 7B in conjunction with FIGS. 1–5, tail portions 30*a* of signal terminals 30 are shown inserted into elongated slots 36 in circuit board 14 in the direction of arrow "D". Again, the tail portions are inserted in directions "D" generally perpendicular to the circuit board and generally parallel to mounting direction "B" (FIG. 3) of connector 12 onto circuit board 14. However, it can be seen that tail portions 30*a* of the power terminals are not bent so that they could extend perpendicularly to the circuit board. Consequently, elongated slots 36 are sufficiently long to accommodate distal ends of the angled tail portions which extend generally at the acute angle of mating portion 26 relative to circuit board 14 as indicated by the mating direction "A" described above in relation to FIG. 3.

Similar to angled tail portions 30*a* of power terminals 30 shown in FIGS. 7A and 7B and described above, angled tail portions 32*a* of RF terminals 32 are inserted into elongated slots 38 in a direction generally perpendicular to the circuit board notwithstanding the fact that tail portions 32*a* of the RF terminals are at an angle to the board. Like slots 36, elongated slots 38 are of sufficiently lengths to accommodate the distal ends of the angled tail portions 32*a* of RF terminals 32.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector system which includes a connector mounted on a printed circuit board and for mating with a mating connector in a mating direction at an acute angle to the circuit board, comprising:

a connector housing mounting at least two sets of first and second terminals, the connector housing being mountable on the circuit board in a mounting direction generally perpendicular to the board, the first terminals having tail portions extending in said mounting direction generally perpendicular to the circuit board, and the second terminals having tail portions extending at the acute angle to said mounting direction; and the printed circuit board having holes for receiving the tail portions of the first terminals and an elongated slots for receiving the angled tail portions of the second terminals, the slots being sufficiently long to accommodate distal ends of the angled tail portions which extend at the acute angle to the mounting direction.

2. The electrical connector system of claim 1 wherein said connector housing has a mating portion which extends in said mating direction for mating with the mating connector at the acute angle to the printed circuit board.

3. The electrical connector system of claim 1 wherein said connector housing comprises a housing of a hybrid connector, and said first terminals comprise signal terminals and said second terminals comprise power terminals.

4. The electrical connector system of claim 1 wherein said connector housing comprises a housing of a hybrid connector, and said first terminals comprise signal terminals and said second terminals comprise RF terminals.

5. The electrical connector system of claim 4, including a set of third terminals comprising power terminals having tail portions extending at the acute angle to said mounting direction and insertable into the elongated slots in the printed circuit board.

6. An electrical connector system which includes a hybrid connector mounted on a printed circuit board and for mating with a mating connector in a mating direction at an acute angle to the circuit board, comprising:

a hybrid connector housing mounting at least two sets of first and second terminals, the connector housing being mountable on the circuit board in a mounting direction generally perpendicular to the board, the connector housing having a mating portion which extends in said mating direction for mating with the mating connector at an acute angle to the printed circuit board, the first terminals comprising signal terminals having tail portions extending in said mounting direction generally perpendicular to the circuit board, and the second terminals comprising power terminals having tail portions extending at the acute angle to said mounting direction; and the printed circuit board having holes for receiving the tail portions of the signal terminals and an elongated slots for receiving the angled tail portions of the power terminals, the slots being sufficiently long to accommodate distal ends of the angled tail portions which extend at the acute angle to the mounting direction.

7. The electrical connector system of claim 6 wherein the mating portion of the hybrid connector housing includes a signal section and a power section.

8. The electrical connector system of claim 6, including a set of RF terminals having tail portions extending at the acute angle to said mounting direction and insertable into an elongated slots in the printed circuit board.

* * * * *